US009617125B2

(12) United States Patent
Gomani et al.

(10) Patent No.: US 9,617,125 B2
(45) Date of Patent: Apr. 11, 2017

(54) CRANE WITH AUTOMATIC ADJUSTABLE TIGHTENING MECHANISM

(71) Applicants: Ronen Gomani, Tsfat (IL); Timor Shefi, Tsfat (IL); Itamar Goeta, Kiryat Gat (IL)

(72) Inventors: Ronen Gomani, Tsfat (IL); Timor Shefi, Tsfat (IL); Itamar Goeta, Kiryat Gat (IL)

( * ) Notice: Subject to any disclaimer, the term of this patent is extended or adjusted under 35 U.S.C. 154(b) by 0 days.

(21) Appl. No.: 15/065,949

(22) Filed: Mar. 10, 2016

(65) Prior Publication Data

US 2016/0244305 A1 Aug. 25, 2016

Related U.S. Application Data

(63) Continuation-in-part of application No. 14/629,565, filed on Feb. 24, 2015, now abandoned.

(51) Int. Cl.
*E04G 25/00* (2006.01)
*B66C 23/20* (2006.01)
*B66C 23/26* (2006.01)

(52) U.S. Cl.
CPC ..... *B66C 23/201* (2013.01); *B66C 23/20* (2013.01); *B66C 23/26* (2013.01)

(58) Field of Classification Search
CPC ..... B66C 23/201; B66C 23/20; B66C 23/26; B66C 23/00; B66C 23/005
USPC ..... 248/200.1, 125.1, 644, 354.1, 354.4–6; 212/255, 260, 292, 294, 296, 199, 300, 212/223, 263, 256
See application file for complete search history.

(56) References Cited

U.S. PATENT DOCUMENTS

| | | | | |
|---|---|---|---|---|
| 2,107,500 A * | 2/1938 | Price | B66C 23/202 | 212/223 |
| 2,604,303 A | 7/1952 | Grady | | |
| 2,985,430 A * | 5/1961 | Greenwood | B66C 23/201 | 254/338 |
| 4,096,952 A * | 6/1978 | Diggs | B66C 23/201 | 212/176 |
| 4,554,691 A * | 11/1985 | Daugherty | A61G 7/1017 | 318/16 |
| 4,928,916 A | 5/1990 | Molloy | | |
| 7,681,747 B2 * | 3/2010 | Crowder | B66C 23/22 | 212/166 |
| 8,152,118 B2 * | 4/2012 | Melic | E04G 21/3233 | 248/161 |
| 2003/0006354 A1 * | 1/2003 | Biles | B25H 3/006 | 248/354.1 |

FOREIGN PATENT DOCUMENTS

| | | |
|---|---|---|
| ES | 2024905 | 1/1992 |

* cited by examiner

*Primary Examiner* — Christopher E Garft

(57) ABSTRACT

A hoisting crane that comprises a male shaft, a female shaft, a locking shaft, a tightening spring, a hoisting arm, a pressure arm, a top shoe, a bottom shoe, a top bearing, and a bottom bearing. The crane is portable and collapsible and is equipped with an automatic adjusting tightening mechanism that fixes and secures the crane to the work room floor and ceiling using a spring and in a way that the greater the load on the crane, the more the pressure arm increases the tightening force that the crane applies to the work room floor and ceiling.

2 Claims, 7 Drawing Sheets

CRANE WITH AUTOMATIC ADJUSTABLE TIGHTENING MECHANISM

TECHNICAL FIELD

The present invention refers to a portable and collapsible crane that can be secured tightly to the ceiling and floor of the work site using a spring and a pressure arm such that the greater the load on the crane's hoisting arm, the tighter the crane is fixed to the ceiling and floor.

BACKGROUND ART

It is often necessary to use a crane to lift and move loads in buildings, production floors, rooms, and other such spaces (hereinafter "work room"). It is customary to fix such cranes to the work room floor and ceiling by drilling holes in the floor and ceiling and securing the crane with bolts or screws. When the job performed in the said work room is temporary and short term and of a nature that requires the use of a crane, drilling holes in the work room ceiling and floor obviously poses an aesthetic problem and sometimes even a safety risk. In addition, it is unsafe to use cranes that are fixed to the ceiling and floor by means of a spring, since when heavy loads are hoisted, the tightening force of the spring may be insufficient to secure the crane to the work room ceiling and floor. The present invention offers a good and effective solution to the abovementioned problems.

DESCRIPTION OF THE DRAWINGS

The intention of the drawings attached to the application is not to limit the scope of the invention and its application.

The drawings are intended only to illustrate the invention and they constitute only one of its many possible implementations.

THE INVENTION

Figure 2:
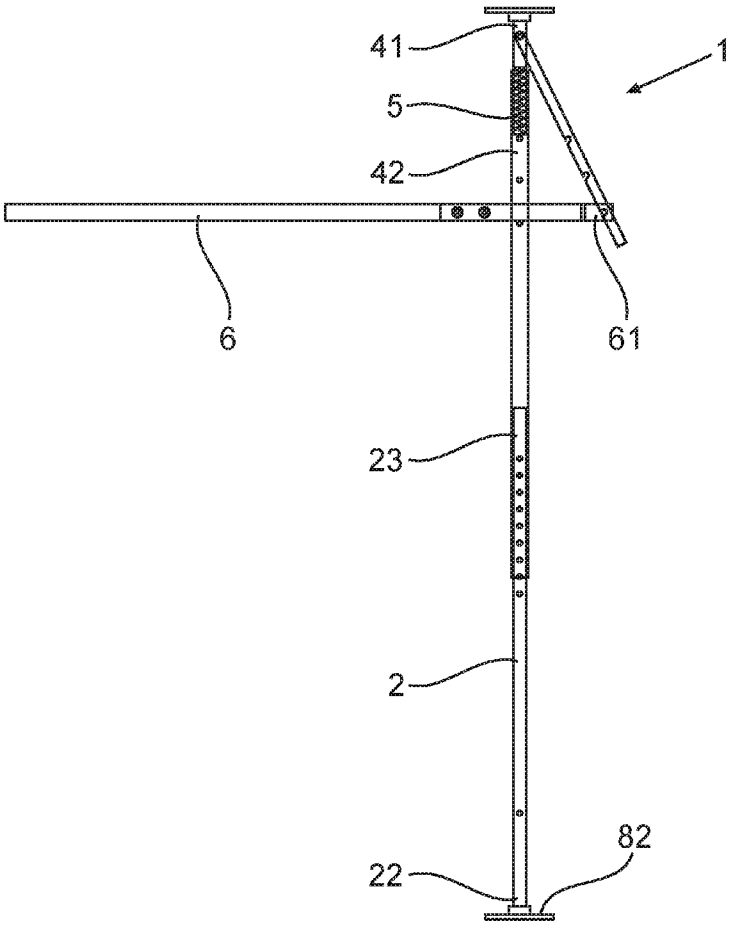
FIG. 2 presents a side-view cross section of the hoisting crane (1).
Figure 1:
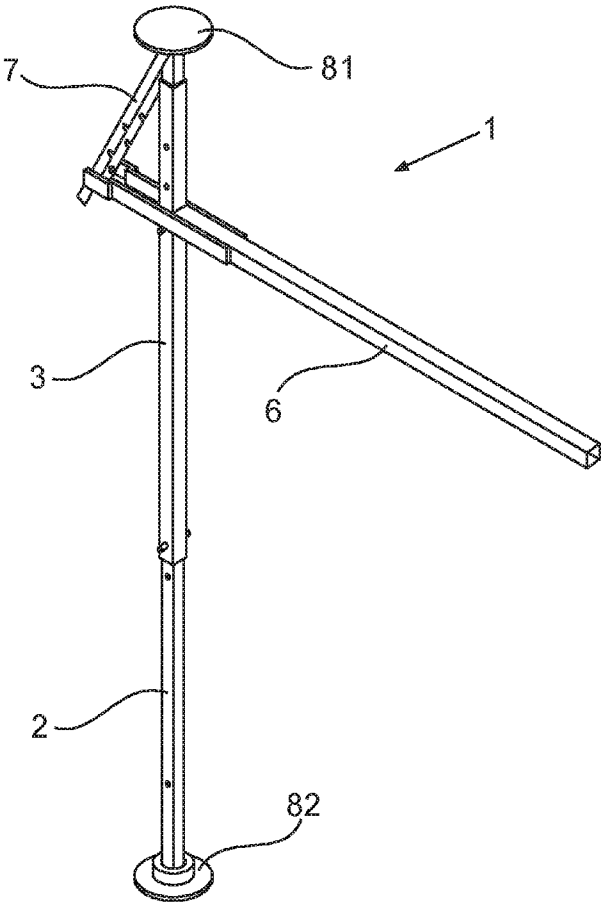
FIG. 1 depicts the hoisting crane (1) in perspective.
Figure 5:
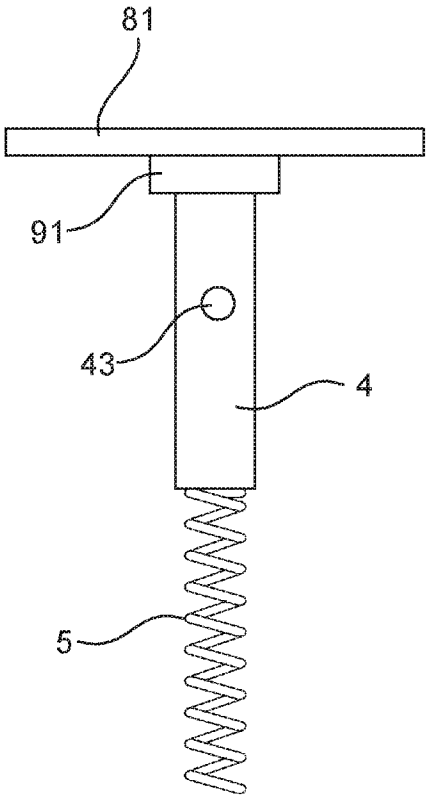
FIG. 5 depicts the locking shaft (4), the spring (5), the top bearing (91), and the top shoe (81).
Figure 4:
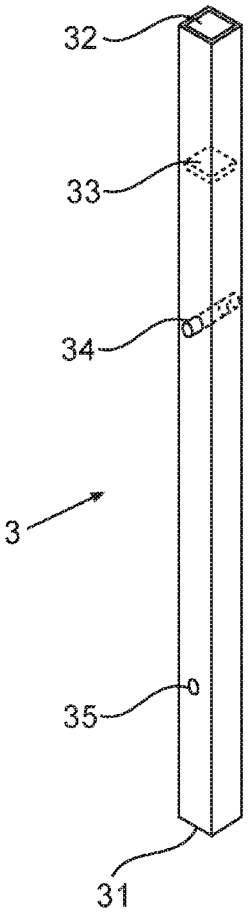
FIG. 4 depicts the female shaft (3).
Figure 3:
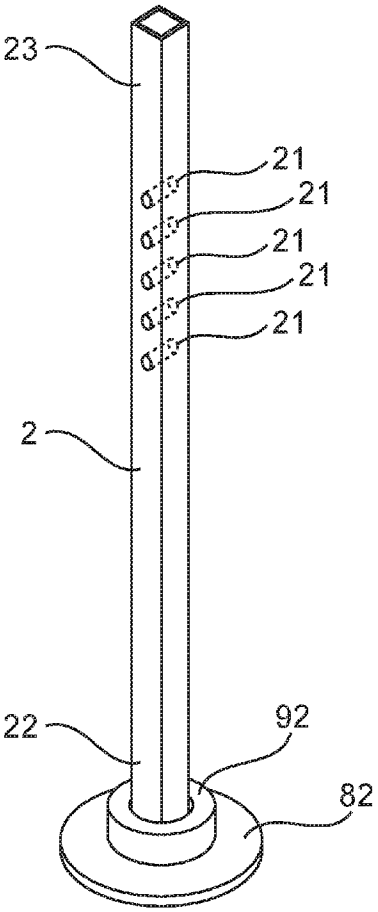
FIG. 3 depicts the male shaft (2), the bottom bearing (92), and the bottom shoe (82).
Figure 7:
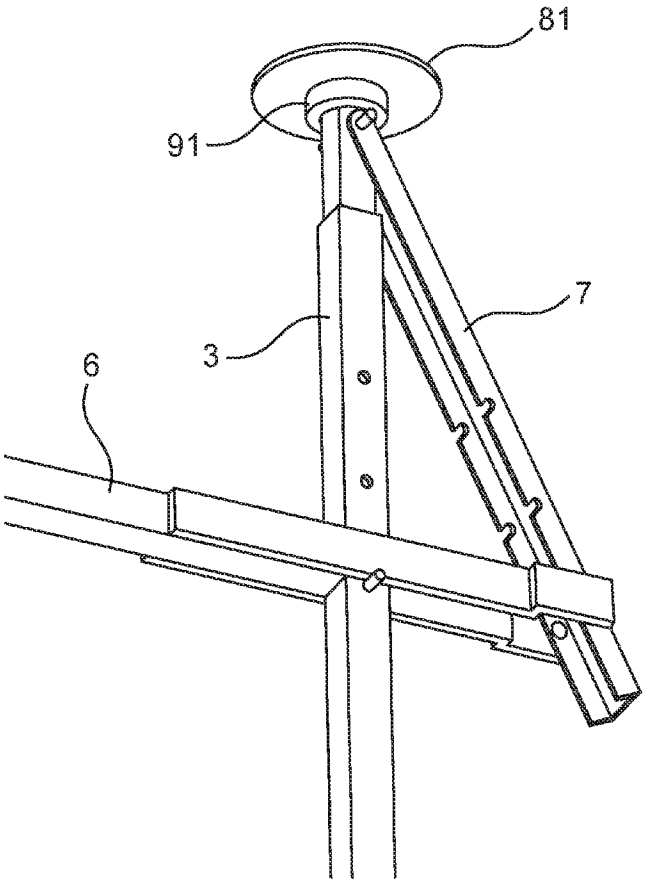
FIGS. 6 and 7 depict the upper part of the hoisting crane (1), without the bearings.
Figure 6:
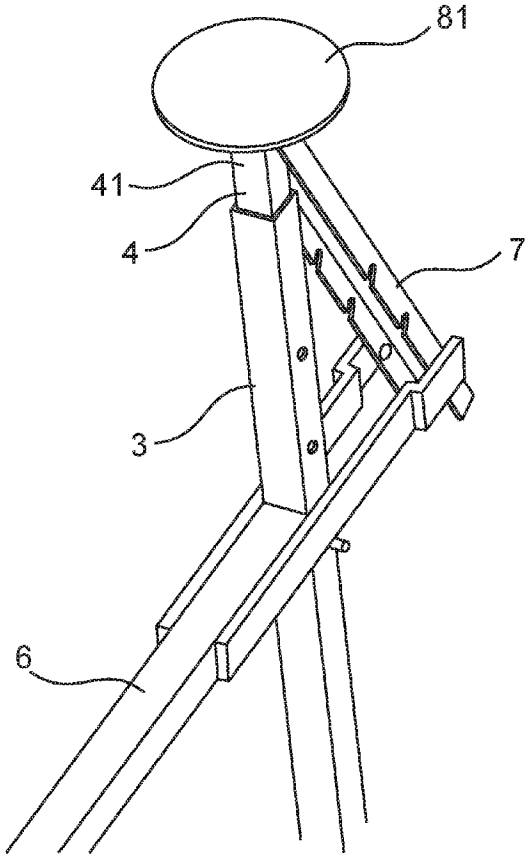
Figure 8:
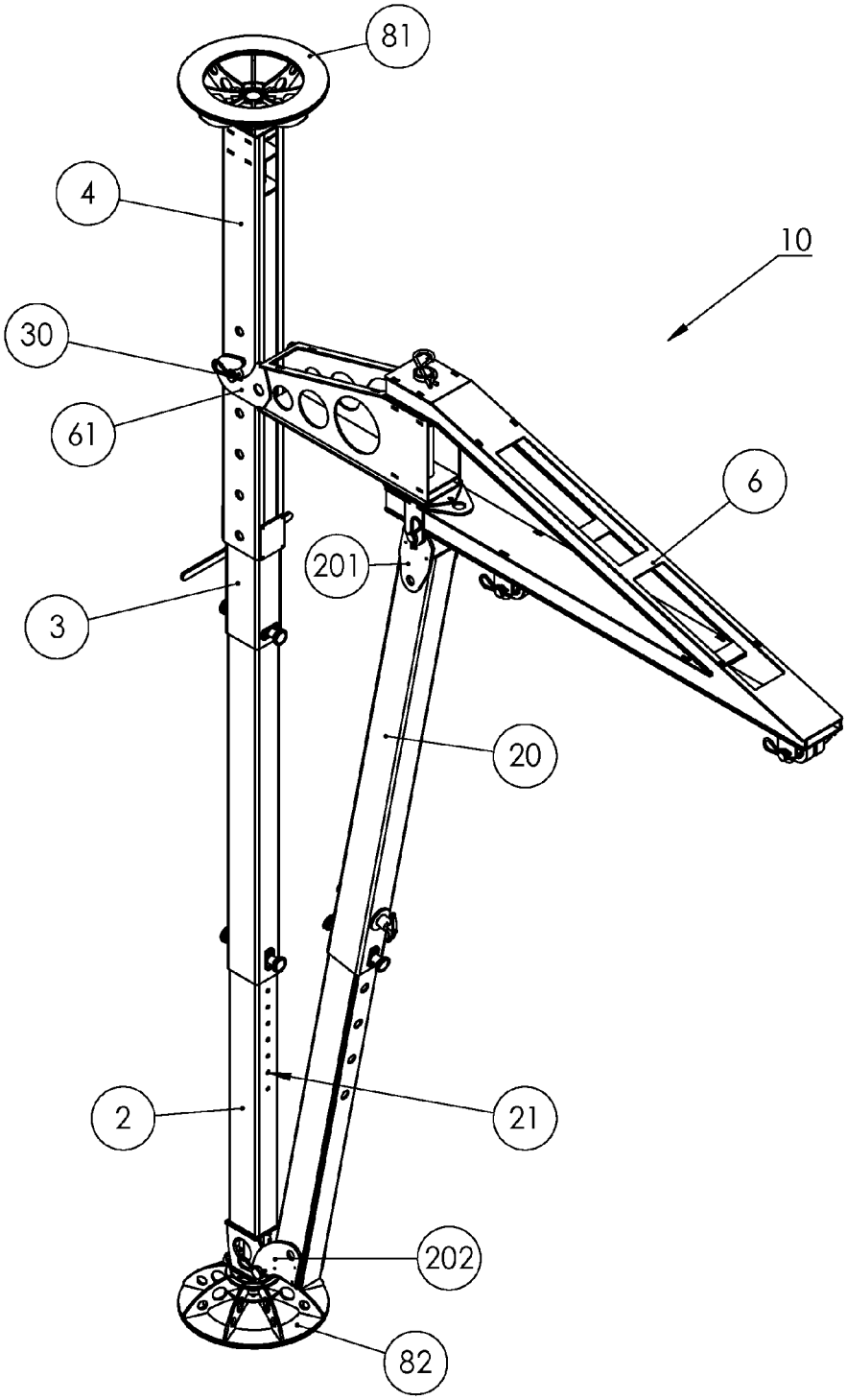
FIG. 8 depicts the hoisting crane (10) in perspective.
Figure 9:
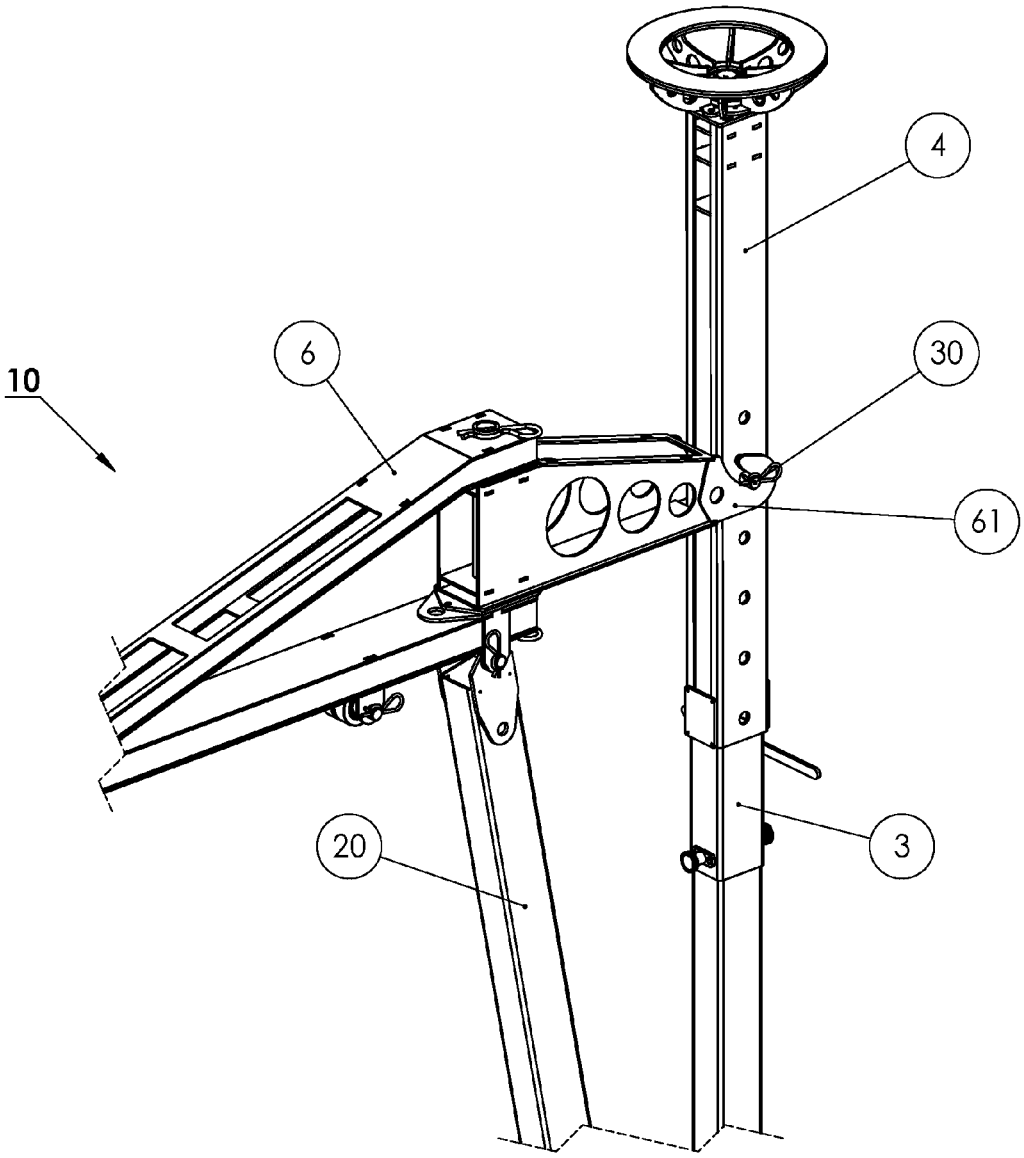
FIGS. 9 and 10 depict the top part of the hoisting crane (10).
Figure 10:
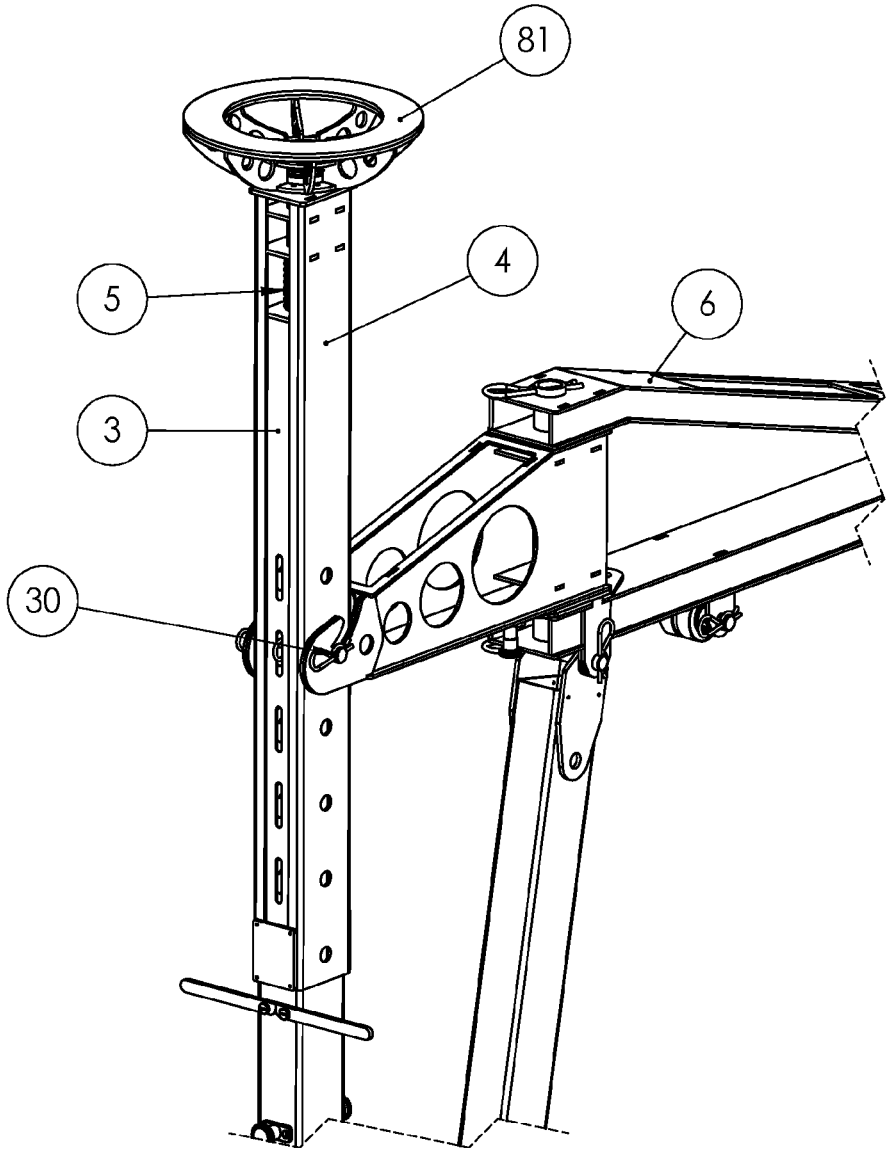

The main objective of the present invention is to provide a portable and collapsible hoisting crane that includes an automatic adjustable tightening mechanism that fixes and secures the crane to the work room floor and ceiling by means of a spring and a pressure arm. The said mechanism is designed so that the heavier the load on the crane, the tighter the crane is fixed to the floor and ceiling of the work room, Thus, the crane is fixed and secured to the ceiling and floor with a force that corresponds to the weight of the load on the crane at any given time.

The hoisting crane (1), subject of the present invention, is depicted in general in Drawings Nos. 1 and 2, and it comprises a male shaft (2), a female shaft (3), a locking shaft (4), a tightening spring (5), a hoisting arm (6), a pressure arm (7), a top shoe (81), a bottom shoe (82), a top bearing (91), and a bottom bearing (92). The components of the crane (1) can and should be made of rigid, strong, and light materials.

The male shaft (2) is, in general, a long rod with several holes (21) in its upper end. The bottom (22) of the male shaft (2) is attached to the bottom bearing (92), and the bottom bearing (92) is attached to the bottom shoe (82) in a way that enables the male shaft (2) to rotate around its axis while the bottom shoe (82) remains fixed and does not rotate. Drawing No. 3 depicts the male shaft (2), which is attached to the bottom bearing (92), which in turn is attached to the bottom shoe (82).

The female shaft (3) is, in general, a long, hollow rod with a top opening (32) and a bottom opening (31) through which the male shaft (2) may be inserted into the female shaft (3). The female shaft (3) has an internal stopper in its upper part, which may be an internal protrusion (33), an external support means, which may be an external protrusion (34), and a locking hole (35) in its bottom part. Drawing No. 4 depicts the female shaft (3) with the abovementioned components.

The locking shaft (4) is a relatively short rod. The top end (41) of the locking shaft (4) is attached to the top bearing (91), which in turn is attached to the top shoe (81) in such a way that enables the locking shaft (4) to rotate around its axis while the top shoe (81) remains fixed and does not rotate. The bottom end (42) of the locking shaft (4) is attached to a spring (5), as depicted in Drawing No. 5.

The hoisting arm (6) is a long rod and the pressure arm (7) is a relatively short rod, as depicted in the drawings.

Assembly of the system (1) components: The locking shaft (4) is inserted into the female shaft (3) through the top opening (32) until the spring (5) is stopped by the internal protrusion stopper (33). Next, the upper end (23) of the male shaft (2) is inserted into the female shaft (3) through the bottom opening (31) until the top shoe (81) is tightly secured against the ceiling and the bottom shoe (82) is tightly secured against the floor.

Downward force is now exerted on the male shaft and upward force is exerted on the female shaft so that the spring (5) is sufficiently compressed. A locking pin is inserted through the locking hole (35) in the female shaft (3) and into a corresponding hole (21) in the male shaft (2). The male shaft (2) and female shaft (3) are now fixed to the floor and ceiling. The upper part of the pressure arm (7) is then attached by means of an axial joint to the rear part (61) of the hoisting arm (6). The said axial joint may be any kind of a variety of axial joints, such as a pin, and so on. Finally, the hoisting arm (6) is positioned on the external support protrusion (34) on the female shaft (3) and the crane is ready for use.

Fixing and tightening of the hoisting crane (1): When a load is mounted on the hoisting arm (6), a vertical, downward force acts on the external support protrusion (34) on the female shaft (3) that tightens the bottom shoe (82) to the floor and at the same time a vertical, upward force act on the pressure arm (7) that causes tightening of the top shoe (81) to the ceiling. Thus, the greater the load on the crane, the tighter the crane is fixed to the work room ceiling and floor. Thanks to the special structure of the hoisting crane (1), subject of the present patent application, the more weight there is on the crane, the tighter the crane is fixed to the work room ceiling and floor, and obviously, the heavier the load on the hoisting crane (1), the greater the force required to secure the crane so as to prevent it from falling over or tilting sideways. Drawings Nos. 6 and 7 depict the upper part of the hoisting crane (1).

According to the above explanation, the locking shaft (4) is inserted into the upper part of the female shaft (3). The invention may, however, also be implemented such that the locking shaft (4) is inserted over the female shaft (4) in such a way that the spring (5) is stopped by some external stopper such as an external stopping protrusion. In addition, the bearings (91) (92) may be positioned in different locations on both the locking shaft (4) and the male shaft (2), in a way that permits horizontal rotation of the hoisting arm (6) without rotating the shoes (81) (82).

The hoisting crane (1), subject of the present invention, is relatively light weight, collapsible and portable, and can be easily transported in the trunk of a standard vehicle without taking up much space. It can be assemble easily and quickly in the work room wherever it is needed, without drilling holes in the work room floor or ceiling, and it can be secured and tightened easily, with a tightening force that changes according to the load on the hoisting crane (1) itself.

The second version of the Hoisting Crane (10) is described in FIGS. 8-12 and it comprises a male shaft (2), a female shaft (3), a locking shaft (4), a tightening spring (5), a hoisting arm (6), a top shoe (81), a bottom shoe (82), a top bearing (91), and a bottom bearing (92). The second version of the Hoisting Crane is also includes a diagonal supportive rod (20) and it does not includes a pressure arm.

The top end (201) of the rod 20 is attached to the hoisting arm (6) and its bottom end (202) is attached to the bottom bearing (92) and alternatively it can be attached to the bottom end of the male shaft (2). The rod (20) observed part of the vertical pressure of the hoisting arm (6) any by that provide more stability to the Hoisting Crane (10) in general. The rear part (61) of the hoisting arm (6) is attached by means of an axial joint (30) to the locking shaft (4). In the second version of the Hoisting Crane (10) the locking shaft (4) is assembled over the female shaft (3) until the spring (5) is stopped by the top end (31) of the female shaft (3). When a load is mounted on the hoisting arm (6), a vertical upward force acts on the axial joint 30 and the locking shaft (4) that causes tightening of the top shoe (81) to the ceiling.

Figure 11:
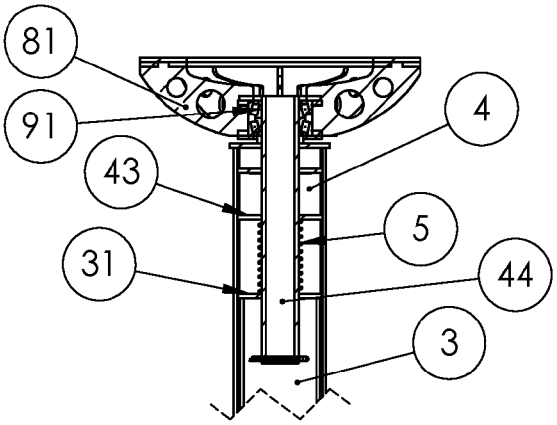
FIG. 11 depicts the top shoe (81) and the top bearing (91).
Figure 12:
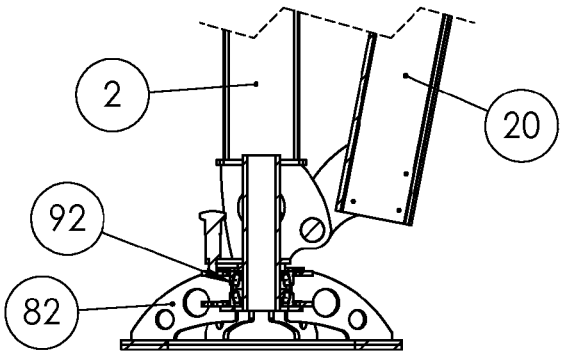
FIG. 12 depicts the bottom shoe (82) and the bottom bearing (92).

The locking shaft (4) is also described in FIG. 11, and it may include a vertical rod (44) on which the spring (5) is assembled, and a stopper (43) which is designed to stop the spring (5) which is tighten upward. The spring (5) is not active when the Hoisting Crane (10) is in used, and its main function is when the user fixes and tightens the hoisting crane. The user pushes the female shaft (3) upwardly and the male shaft (2) downwardly until the spring is pressed between the stopper (43) and the top end of the female shaft (3) and the pressed spring (5) locks the Hoisting Crane (10) to the floor and the ceiling.

In use, when a load is mounted on the hoisting arm (6), a vertical, downward force acts on the diagonal supportive rod (20) that tightens the bottom shoe (82) to the floor. At the same time a vertical, upward force act on the axial joint (30) and the locking shaft (4) that causes tightening of the top shoe (81) to the ceiling. In use, the spring (5) is not aimed to function.

The "bearing" (91) (92) components of both versions of the hoisting cranes can be replaced by any other means that serve in same function, such as a spherical joint based on principle of s mortar and pestle or any other kind.

What is claimed is:

1. A hoisting crane (1) that is designed to be secured between a ceiling and a floor that includes an automatic adjustable tightening mechanism, comprises: male shaft (2), a female shaft (3), a locking shaft (4), a tightening spring (5), a hoisting arm (6), a pressure arm (7), a top shoe (81), a bottom shoe (82), a top bearing (91), and a bottom bearing (92);

wherein the male shaft (2) is a long rod with several holes (21); wherein a bottom (22) of said male shaft (2) is attached to the bottom bearing (92), which in turn is attached to the bottom shoe (82);

wherein the female shaft (3) is a long hollow rod with a bottom opening (31) and a top opening (32); wherein an upper part of said female shaft (3) has a stopper (33) and an external support protrusion (34); wherein a bottom part of the female shaft (3) has a locking hole (35);

wherein the locking shaft (4) is a short rod whose upper end (41) is attached to the top bearing (91), which in turn is attached to the top shoe (81); and wherein a bottom end (42) of said locking shaft (4) is attached to the tightening spring (5);

wherein said tightening spring (5), while connected to said locking shaft (4), is aimed to be inserted into the female shaft (3) through the top opening (32) until said tightening spring (5) stops on said stopper (33) of the female shaft (3);

wherein an upper end (23) of the male shaft (2) is aimed to be inserted into the female shaft (3) through the bottom opening (31) until the top shoe (81) is tightly secured against the ceiling and the bottom shoe (82) is tightly secured against the floor; wherein a locking pin is aimed to be inserted through the locking hole (35) of the female shaft (3) and into a corresponding hole (21) of the male shaft (2); whereby a downward force is exerted on the male shaft and upward force is exerted on the female shaft when said tightening spring (5) is compressed between said stopper (33) of the female shaft (3) and said bottom end (42) of said locking shaft (4);

wherein one end of said pressure arm (7) is attached by means of an axial joint to a rear part (61) of said hoisting arm (6); wherein a second end of said pressure arm (7) is attached to the top bearing (91); wherein said hoisting arm (6) is positioned on said external support protrusion (34) of the female shaft (3);

whereby when a load is mounted on said hoisting arm (6), a vertical downwardly force acts on said external support protrusion (34) of the female shaft (3) that tightens the bottom shoe (82) to the floor and at the same time a vertical upwardly force acts on the pressure arm (7) that causes tightening of the top shoe (81) to the ceiling; whereby the greater the load on the hoisting crane (1), the tighter said hoisting crane is fixed to the ceiling and floor.

2. A hoisting crane (10) that is designed to be secured between a ceiling and a floor that includes an automatic adjustable tightening mechanism, comprises: male shaft (2), a female shaft (3), a locking shaft (4), a tightening spring (5), a hoisting arm (6), a diagonal supportive rod (20), a top shoe (81), a bottom shoe (82), a top bearing (91), and a bottom bearing (92);

wherein the male shaft (2) is a long rod with several holes (21); wherein a bottom of said male shaft (2) is attached to the bottom bearing (92), which in turn is attached to the bottom shoe (82);

wherein the female shaft (3) is a long hollow rod with a bottom opening and a top opening (32); wherein a bottom part of the female shaft has a locking hole (35);

wherein said locking shaft (4) includes a vertical rod (44) on which the tightening spring (5) is assembled, and a stopper (43) which is designed to stop said tightening spring (5); wherein the locking shaft (4) is assembled over the female shaft (3) wherein the tightening spring (5) is located between a top end (31) of the female shaft (3) and said stopper (43) of the locking shaft (4); wherein an upper end of said vertical rod (44) is attached to the top bearing (91), which in turn is attached to the top shoe (81);

wherein an upper end (23) of the male shaft (2) is aimed to be inserted into the female shaft (3) through the bottom opening of said female shaft until the top shoe (81) is tightly secured against the ceiling and the bottom shoe (82) is tightly secured against the floor; wherein a locking pin is aimed to be inserted through the locking hole (35) in the female shaft (3) and into a corresponding hole (21) in the male shaft (2);

wherein a top end (201) of the diagonal supportive rod (20) is attached to the hoisting arm (6) and a bottom end (202) of said diagonal supportive rod (20) is attached to the bottom bearing (92) or to the bottom end of the male shaft (2);

wherein said hoisting arm (6) is positioned on the top end of the diagonal supportive rod (20) and wherein a rear part (61) of said hoisting arm (6) is attached by means of an axial joint (30) to the locking shaft (4);

whereby when assembling together said male shaft and said female shaft and a vertical force applied upwardly on the female shaft (3) and a vertical force applied downwardly on the male shaft (2) the tightening spring is pressed between the stopper (43) of the locking shaft (4) and a top end of the female shaft (3) and a pressure of said tightening spring (5) locks the male shaft (2) to the floor and the female shaft (3) to the ceiling;

whereby when a load is mounted on said hoisting arm (6), the diagonal supportive rod (20) observed part of a vertical pressure of said hoisting arm (6) and whereby provides more stability to the hoisting crane (10); whereby when a load is mounted on said hoisting arm (6), a vertical, downward force acts on said diagonal supportive rod (20) that tightens the bottom shoe (82) to the floor and at the same time a vertical, upward force acts on the axial joint (30) of the locking shaft (4) that causes tightening of the top shoe (81) to the ceiling; whereby the greater the load on the hoisting crane (10), the tighter said hoisting crane is fixed to the ceiling and floor.

* * * * *